US005810176A

United States Patent [19]

Stravitz

[11] Patent Number: 5,810,176

[45] Date of Patent: Sep. 22, 1998

[54] FILE FOLDER/ORGANIZER RACK

[76] Inventor: David M. Stravitz, 16 Park Ave. Suite 14A, New York, N.Y. 10016

[21] Appl. No.: 746,231

[22] Filed: Nov. 7, 1996

[51] Int. Cl.[6] ..... B42F 7/00

[52] U.S. Cl. ..... 211/55; 211/11; 211/45

[58] Field of Search ..... 211/55, 126.13, 211/11, 41.12, 41.18, 45, 50, 186, 40; D6/569, 570, 407, 462, 467, 473, 476; D19/65, 75, 78, 86, 90, 91, 95, 99, 100

[56] References Cited

U.S. PATENT DOCUMENTS

| | | | |
|---|---|---|---|
| D. 247,645 | 3/1978 | Woodhall | D6/569 X |
| D. 348,366 | 7/1994 | Stravitz . | |
| 2,769,550 | 11/1956 | Rollins et al. | 211/11 |
| 2,879,899 | 3/1959 | Shenkin | 211/55 |
| 3,167,873 | 2/1965 | Toms | 211/55 X |
| 4,228,743 | 10/1980 | Crook | D6/569 |
| 4,328,631 | 5/1982 | Foerster | 211/55 X |
| 5,035,332 | 7/1991 | Stravitz . | |
| 5,109,991 | 5/1992 | Mcpherson et al. | 211/45 |
| 5,199,577 | 4/1993 | Curtis | 211/41.12 X |
| 5,636,752 | 6/1997 | Gallagher | 211/41.12 |

*Primary Examiner*—Blair Johnson
*Attorney, Agent, or Firm*—Frishauf, Holtz, Goodman, Langer & Chick

[57] ABSTRACT

A file folder/organizer rack includes a left support member having an L-shaped supporting wall, and a plurality of parallel, spaced apart left shelves connected with the supporting wall, each left shelf being angled downwardly and rearwardly, and each left shelf having a width less than one-half of a width of the rack; a right support member having an L-shaped supporting wall, and a plurality of parallel, spaced apart right shelves connected with the one supporting wall of the right support member, each right shelf being angled downwardly and rearwardly, with each right shelf being in alignment with a respective left shelf, each right shelf having a width less than one-half of a width of the rack such that a space is provided between the left and right shelves; a plurality of bars interconnecting the supporting wall of the left support member with the supporting wall of the right support member, such that the space is also provided between the supporting walls of the left and right support members; an upper dead space defined above uppermost ones of the shelves and between the left and right support members; an upper storage tray supported on upper ones of the bars in the dead space; a lower dead space defined below lowermost ones of the shelves and between the left and right support members; and a lower storage tray supported in the lower dead space on tabs secured to the L-shaped supporting walls.

35 Claims, 4 Drawing Sheets

FILE FOLDER/ORGANIZER RACK

CROSS REFERENCE TO RELATED APPLICATION

The present application is related to U.S. Design patent application Ser. No. 29/062,426, filed Nov. 4, 1996 directed to the same article as the present application, and the entire contents of which are incorporated hereby reference.

BACKGROUND OF THE INVENTION

This application relates to an organizer rack, and more particularly, is directed to an organizer rack for storing file folders and the like, and having trays for storing additional small items.

Racks for organizing file folders and other small items to be held on a desk are well known. Generally, racks for organizing file folders include a one piece molded member having a plurality of horizontally or vertically oriented shelves which receive the files. However, because of the one piece molded construction, the rack must be shipped as a completed assembly. As a result, the rack is generally bulky for shipping and handling, thereby increasing the cost thereof. Further, since the rack is made from a one piece mold, the rack generally requires more plastic material for the final product than is necessary for structural rigidity, thereby further increasing the cost thereof. A still further problem with such racks is that, since the files are all oriented in a substantially horizontal or vertical orientation, it becomes difficult to see any labels provided on the file folders, and therefore, it becomes necessary to remove the file folders from the rack in order to determine the subject matter of the file folders. This is because the label on one file folder will generally block the view of the label on an adjacent file folder. In addition, by providing that the file folders are arranged either vertically or horizontally, this results in increased dimensions in the height or depth of the organizer rack.

Racks for holding small items on a desk are also known, but such racks are provided separate and apart from the racks for holding and organizing files. Therefore, it becomes necessary to use two separate organizers on a desk, one for file folders and another for the small items, thereby taking up valuable desk space.

SUMMARY OF THE INVENTION

An object of the present invention is to provide a file folder/organizer rack which overcomes the aforementioned problems with the prior art.

It is another object of the present invention to provide a file folder/organizer rack which is easily molded from different parts and shipped in a disassembled state.

It is still another object of the present invention to provide a file folder/organizer rack which uses a reduced amount of plastic material in the molding operation in comparison to a one piece mold, thereby reducing the cost of the mold and the cost of the article.

It is yet another object of the present invention to provide a file folder/organizer rack which has good structural integrity.

It is a further object of the present invention to provide a file folder/organizer rack which can ship in a disassembled, compact form, and which is easy to assemble by a user.

It is a still further object of the present invention to provide a file folder/organizer rack in which the shelves for holding the file folders are angled to provide a staggered relation, thereby permitting easy viewing of any labels on the file folders therein.

It is a yet further object of the present invention to provide a file folder/organizer rack of the aforementioned type in which further trays are provided for holding small items, thereby providing a combined file folder/small item organizer rack.

It is another object of the present invention to provide a file folder/organizer rack which is attractive and practical in use.

In accordance with an aspect of the present invention, a file folder/organizer rack includes a left support member having at least one supporting wall, and a plurality of parallel, spaced apart left shelves connected with the at least one supporting wall, each left shelf being angled downwardly and rearwardly, and each left shelf having a width less than one-half of a width of the rack; a right support member having at least one supporting wall, and a plurality of parallel, spaced apart right shelves connected with the at least one supporting wall of the right support member, each right shelf being angled downwardly and rearwardly, with each of the right shelves being in alignment with a respective left shelf, each right shelf having a width less than one-half of a width of the rack such that a space is provided between the left and right shelves; and a plurality of bars interconnecting the at least one supporting wall of the left support member with the at least one supporting wall of the right support member, such that the space is also provided between the at least one supporting wall of the left and right support members.

Preferably, the at least one supporting wall of each of the left and right shelves has an L-shaped configuration with a side wall and a rear wall.

The shelves are connected to inner surfaces of both the side wall and the rear wall of the respective support member, and are angled at approximately 45° to a vertical. The width of each of the left and right shelves is preferably equal to approximately 20% of the width of the rack. In addition, each of the shelves is of an equal depth, with front edges of the shelves of each support member being in substantial vertical alignment and rear edges of the shelves of each support member being in substantial vertical alignment.

Further, each of the left and right shelves is cut-out to define a substantially U-shaped configuration, with free ends of opposite legs thereof connected with the at least one supporting wall of the respective left and right support member. The at least one supporting wall of the left and right support members is also cut-out in alignment with the cut-outs of the left and right shelves.

The connection of the at least one supporting wall of the left support member with the at least one supporting wall of the right support member by the bars is a removable connection. Preferably, there are four supporting bars connected at opposite corners of the at least one supporting wall of the left and right support members.

In accordance with another aspect of the present invention, a file folder/organizer rack includes a left support member having at least one supporting wall, and a plurality of parallel, spaced apart left shelves connected with the at least one supporting wall, each left shelf being angled downwardly and rearwardly, and each left shelf having a width less than one-half of a width of the rack; a right support member having at least one supporting wall, and a plurality of parallel, spaced apart right shelves connected with the at least one supporting wall of the right support member, each right shelf being angled downwardly and rearwardly, with each of the right shelves being in alignment with a respective left shelf, each right shelf having a width less than one-half of a width of the rack such that a space is provided between the left and right shelves; a plurality of bars interconnecting the at least one supporting wall of the left support member with the at least one supporting wall of the right support member, such that the space is also provided between the at least one supporting wall of the left and right support members; an upper dead space defined above uppermost ones of the shelves and between the left and right support members; and an upper storage tray supported in the dead space.

The storage tray includes a front shelf, a rear ledge, and a deep trough connected between and to the front shelf and the rear ledge. At least one of the front shelf and rear ledge includes a plurality of parallel, spaced apart, lengthwise extending ridges on an upper support surface thereof.

Preferably, the storage tray is supported on upper ones of the bars. Specifically, the front shelf is supported on a front, upper one of the bars and the rear ledge is supported on a rear, upper one of the bars such that the deep trough extends to a position below the upper ones of the bars.

The front shelf includes a downwardly extending flange at a front edge thereof such that the deep trough and the downwardly extending flange inhibit forward and rearward movement of the storage tray.

In accordance with still another aspect of the present invention, a file folder/organizer rack includes a left support member having at least one supporting wall, and a plurality of parallel, spaced apart left shelves connected with the at least one supporting wall, each left shelf being angled downwardly and rearwardly, and each left shelf having a width less than one-half of a width of the rack; a right support member having at least one supporting wall, and a plurality of parallel, spaced apart right shelves connected with the at least one supporting wall of the right support member, each right shelf being angled downwardly and rearwardly, with each of the right shelves being in alignment with a respective left shelf, each right shelf having a width less than one-half of a width of the rack such that a space is provided between the left and right shelves; a plurality of bars interconnecting the at least one supporting wall of the left support member with the at least one supporting wall of the right support member, such that the space is also provided between the at least one supporting wall of the left and right support members; a lower dead space defined below lowermost ones of the shelves and between the left and right support members; and a lower storage tray supported in the dead space.

The lower storage tray includes an L-shaped configuration, with a lower supporting wall and a rear supporting wall.

In addition, first angled support tabs are connected at inner surfaces of the at least one supporting wall of the left and right support members, at positions above a front, lower one of the bars, and second angled support tabs are connected at inner surfaces of the at least one supporting wall of the left and right support members, at positions between and lower than the front, lower one of the bars and a rear, lower one of the bars, the lower supporting wall of the lower storage tray resting on the angled support tabs and the rear supporting wall of the lower storage tray abutting against the rear, lower one of the bars.

The above and other objects, features and advantages of the invention will become readily apparent from the following detailed description thereof which is to be read in connection with the accompanying drawings.

DETAILED DESCRIPTION

Figure 1:
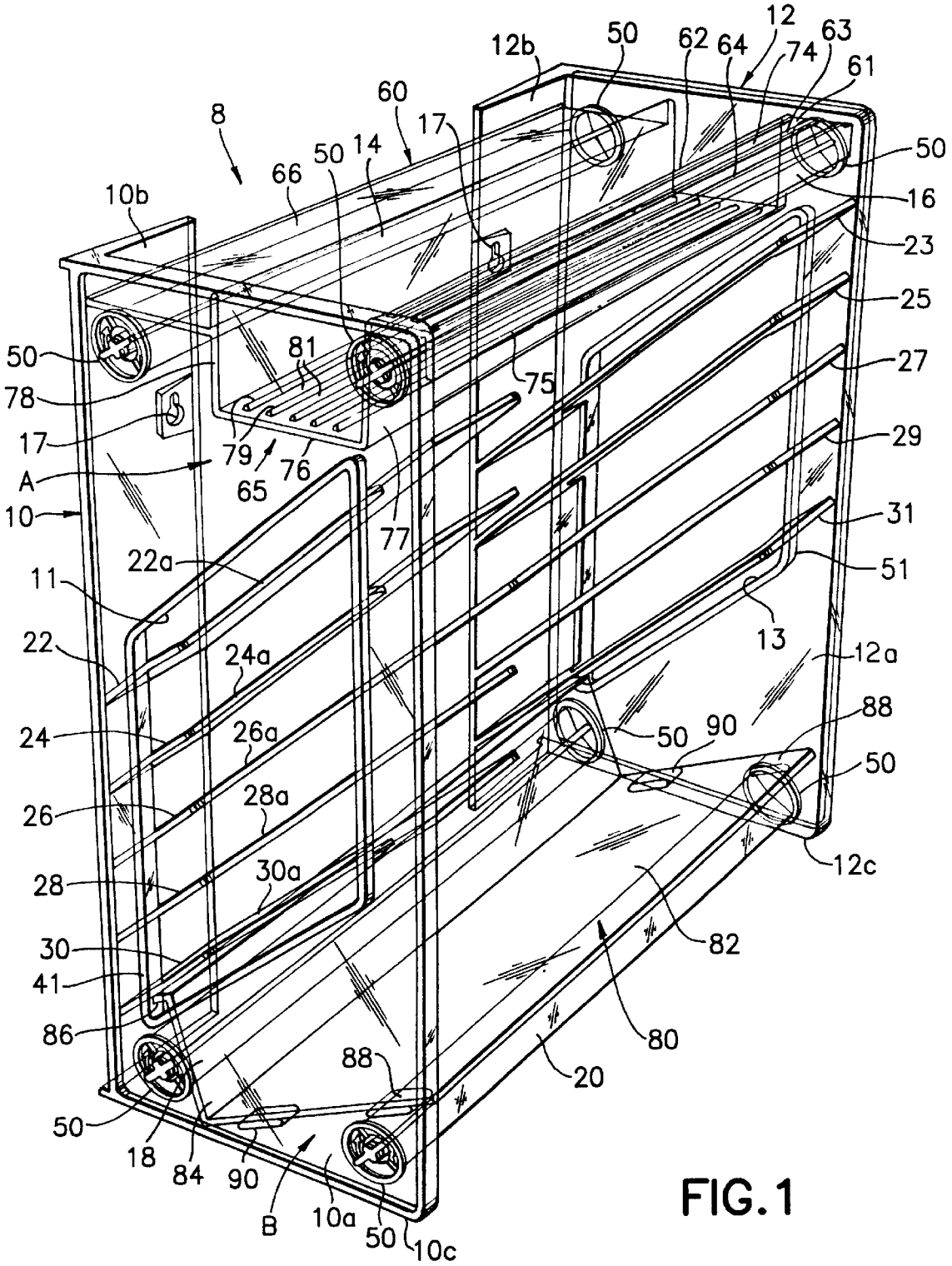
FIG. 1 is a perspective view of a file folder/organizer rack according to the present invention.
Figure 2:
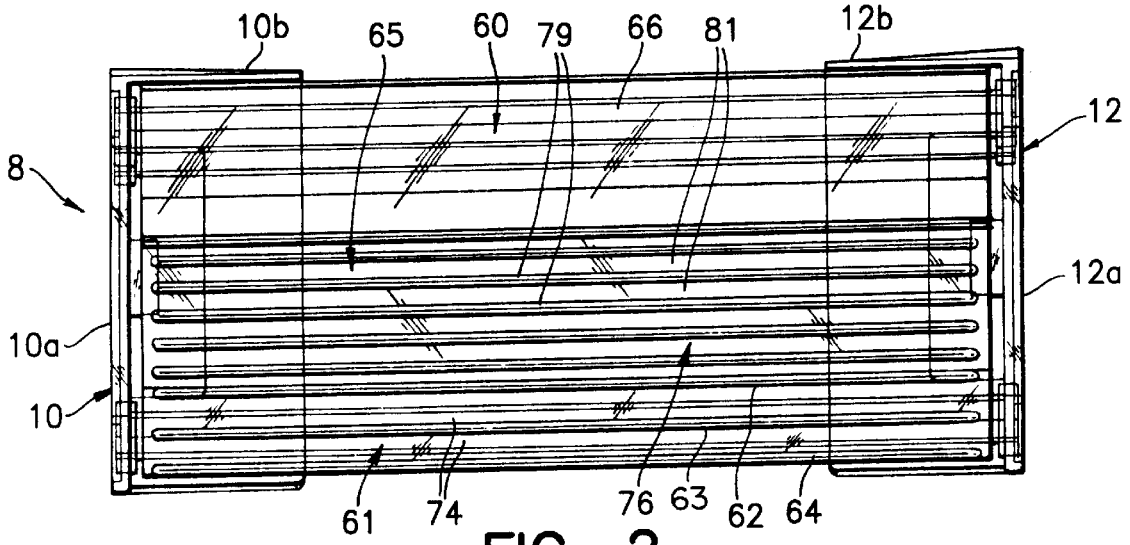
FIG. 2 is a top plan view thereof.
Figure 3:
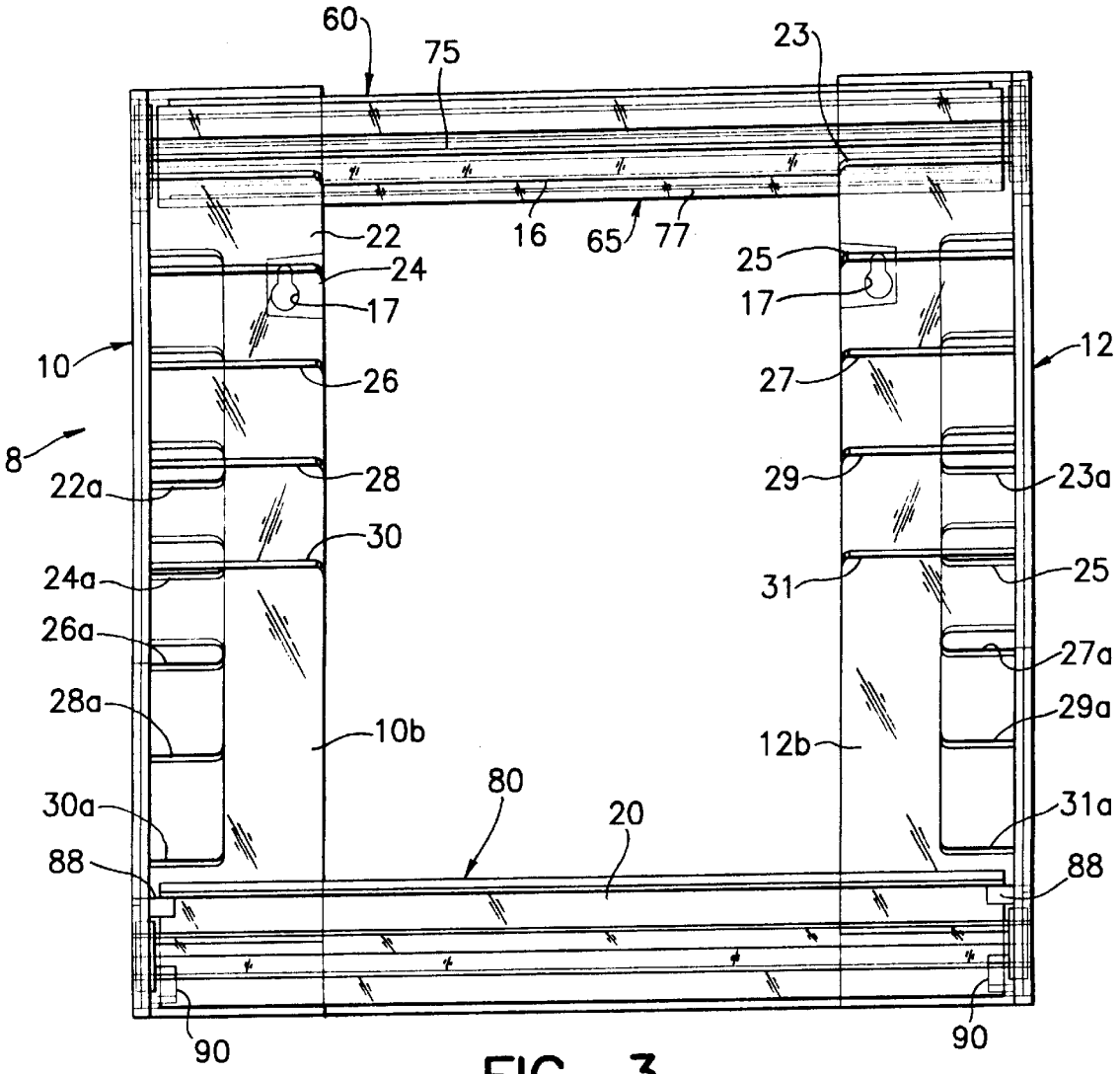
FIG. 3 is a front elevational view thereof.
Figure 4:
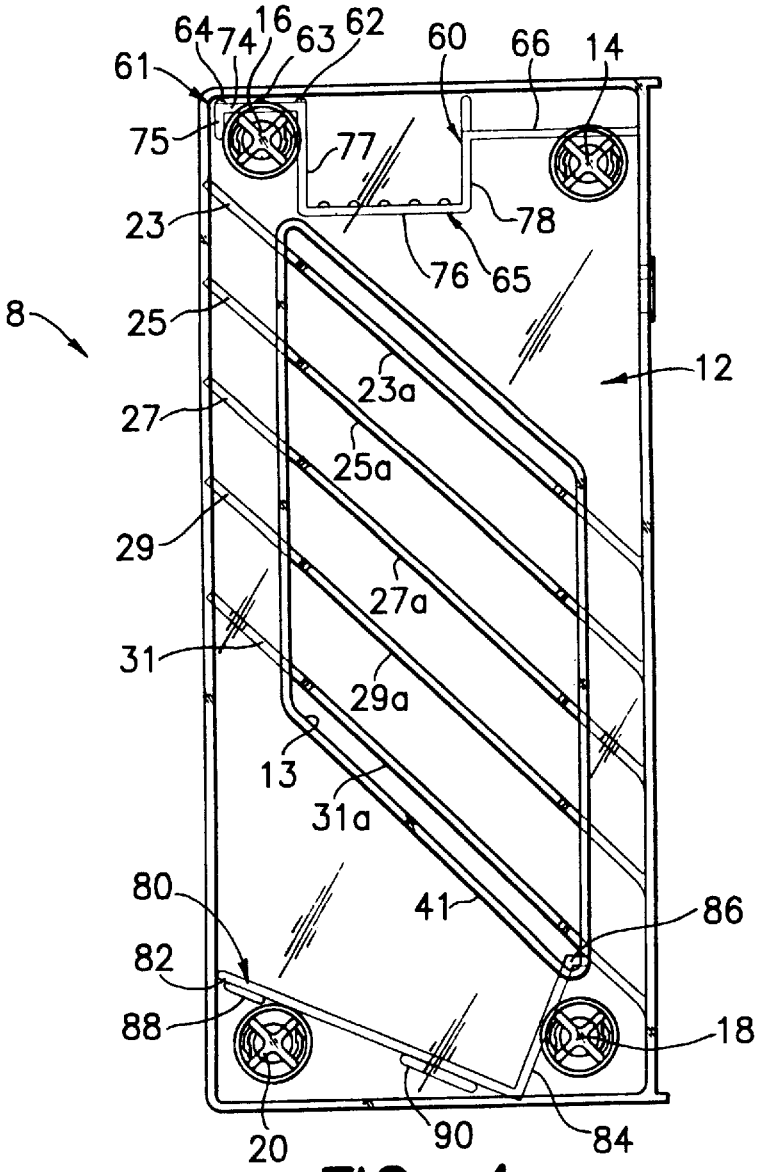
FIG. 4 is a right side elevational view thereof, the left side elevational view being a mirror image thereof.
Figure 5:
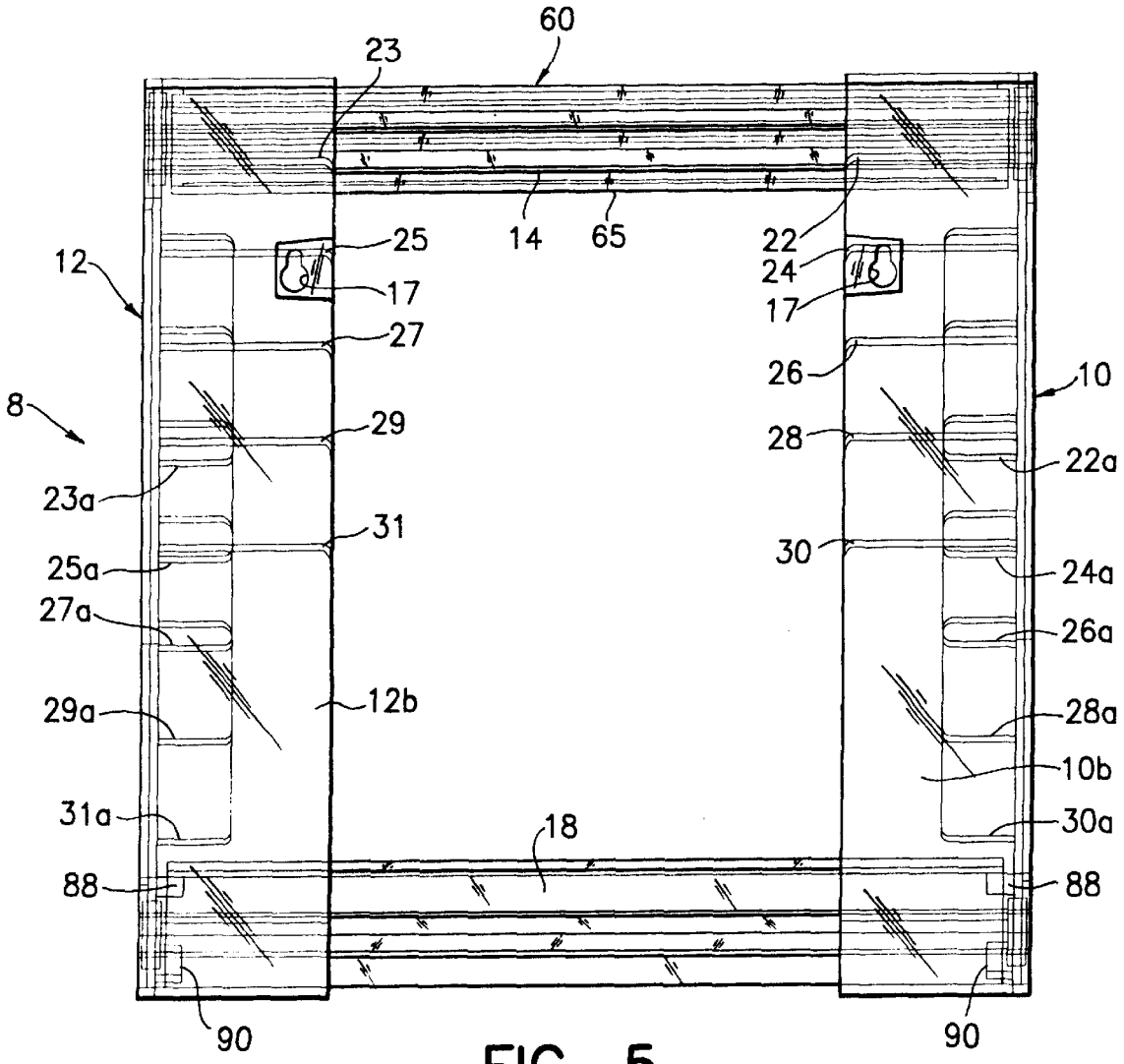
FIG. 5 is a rear elevational view thereof.
Figure 6:
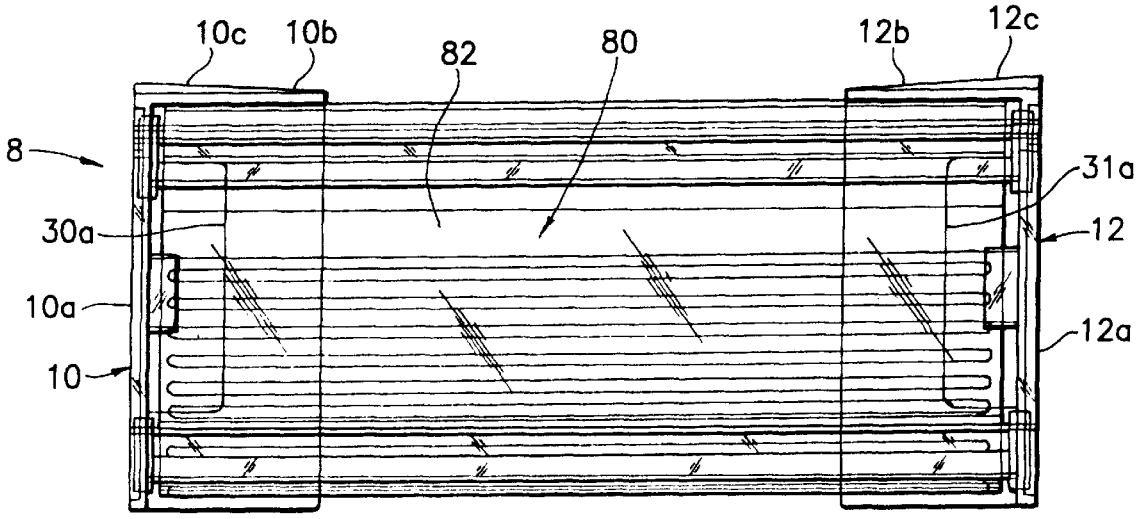
FIG. 6 is a bottom plan view thereof.

Referring to the drawings in detail, a file folder/organizer rack 8 according to the present invention includes a left side support member 10, a right side support member 12 and four transverse interlocking bars 14, 16, 18 and 20 which are removably connected between support members 10 and 12 to hold support members 10 and 12 in parallel, spaced apart relation. Preferably, for ease of viewing items and file folders held by file folder/organizer rack 8, file folder/organizer rack 8 is folded from a transparent plastic material.

Left support member 10 is formed in a generally L-shaped configuration, with an end wall 10*a* and a partial rear wall 10*b* extending from the rear edge of end wall 10*a*. Preferably, left support member 10 is provided with a reinforcing rib or flange 10*c* around the entire outer periphery thereof, except at the inner, free edge of rear wall 10*b*.

In like manner, right support member 12 is also formed in a generally L-shaped configuration, with an end wall 12*a* and a partial rear wall 12*b* extending from the rear edge of end wall 12*a*. As with left support member 10, right support member 12 is provided with a reinforcing rib or flange 12*c* around the entire outer periphery thereof, except at the inner, free edge of rear wall 12*b*.

Four openings 50 are provided near the respective corners in end walls 10*a* and 12*a* for receiving the ends of bars 14–20. Bars 14–20 removably interlock with support members 10 and 12 as shown and described in U.S. Pat. No. 5,035,332, issued Jul. 30, 1991 to the same inventor herein, and the entire contents of which are incorporated hereby by reference. The manner in which the bars 14–20 interlock with the support members 10 and 12, and the particular structures thereof to achieve this interlocking, are not described herein since they are clearly described in said U.S. Pat. No. 5,035,332. When twist-lock bars 14, 16, 18 and 20 are engaged and locked in respective openings of support members 10 and 12, file folder/organizer rack 8 is assembled and ready for use. Of course, any other suitable fastening system, such as screws, press fit, glue, etc. can be used.

With such construction, rack 8 can be free standing on a surface. Alternatively, holes 17 are provided at the upper ends of rear walls 10*b* and 12*b*, whereby rack 8 can be hung from a wall.

Left support member 10 includes a plurality of shelves 22, 24, 26, 28 and 30, each connected at a side edge to the inner surface of end wall 10*a* and at a rear edge to the inner surface of rear wall 10*b*, and extending toward right support member 12. Shelves 22–30 are of equal depth and width and are arranged in spaced apart, parallel relation, with front edges thereof in vertical alignment and rear edges thereof in vertical alignment.

In like manner, a plurality of shelves 23, 25, 27, 29 and 31 are each connected at a side edge to the inner surface of end wall 12*a* and at a rear edge to the inner surface of rear wall 12*b* of right support member 12, and extend toward left support member 10. Shelves 23, 25, 27, 29 and 31 are configured and dimensioned in an identical manner to shelves 22–30. Shelves 21–31 are of equal depth and width and are arranged in spaced apart, parallel relation, with front edges thereof in vertical alignment and rear edges thereof in vertical alignment. Shelves 22–30 and 21–31 are an horizontal alignment. Accordingly, a five shelf storage rack provided by shelves 22–30 and 23–31.

Shelves 22–30 each extend inwardly for a distance of only about 20% of the total spacing between end walls 10*a* and 12*a* of support members 10 and 12. For example, in a preferred embodiment for storing letter-size file folders, the spacing between the inner surfaces of side walls 10*a* and 12*a* of support members 10 and 12 is approximately 12⅝". Accordingly, each of shelves 23–31 extends inwardly by about 2.5". This means that the spacing between the innermost facing edges of shelves 22–30 and the respective shelves 23–31 is about 7⅝". With such dimensions, a file folder placed on opposite shelves, such as on uppermost shelves 22 and 23 or on lowermost shelves 30 and 31, will be supported and will substantially not sag in the middle thereof. As a result, excellent support for file folders and the like is provided, while providing a very large open space between the shelf support members, so that the resultant product requires less plastic material and can be shipped in a flatter configuration for ease of shipping and ease of stocking on the shelves in retail stores. On the other hand, it will be appreciated that too much open space would result in the file folders sagging or falling through. In addition, by providing this open space between opposing shelves 22–30 and shelves 23–31, retrieval of the file folders is facilitated, that is, a person an easily fit his fingers in the open space to retrieve the file folders.

In order to further reduce the amount of plastic material used, each shelf 22–31 has a substantial cut-out portion 22*a*–31*a* at an outermost portion thereof. As a result, each shelf 22–31 has a substantially U-shaped configuration, with opposite legs of the U-shaped configuration being connected with the inner surface of the respective support members 10 and 12.

End walls 10*a* and 12*a* of support members 10 and 12 each include a cut-out portion 11 and 13, respectively, which is in registration with cut-out portions 22*a*–31*a* of shelves 22–31. Cut-out portions 11 and 13 preferably have a general shape of a rhomboid. As a result, since end walls 10*a* and 12*a* each have a very large cut-out portion 11 and 13 therein, less material is required for molding thereof without sacrificing strength. In order to further improve the structural rigidity and strength, outwardly extending ridges 41 and 51 are provided in surrounding relation to cut-out openings 11 and 13, respectively.

As a result of cut-out openings 11 and 13 in support members 10 and 12, respectively, and as a result of cut-out portions 22*a*–31*a* in shelves 22–31, respectively, the resultant structure is easier to mold with a simplified mold, and is fabricated using a minimal amount of plastic material, without substantially sacrificing strength.

According to another feature of the invention, each of shelves 22–31 is inclined or angled approximately 45° relative to the vertical. Accordingly, when a file folder is placed on shelves 22–31, the file folders slide rearwardly and downwardly on shelves 22–31 until they hit the rear walls 10*b* and 12*b* of support members 10 and 12. Further, because of such arrangement, there is a staggering of shelves 22–31. As a result, if file folders are placed on shelves 22–31 in an upside down orientation, the labels of the file folders face, even though facing downwardly, also face outwardly. Thus, the labels can be easily read by an observer when, for example, the rack of the present invention is mounted on a desk, shelf, or the like. This is an important feature of the present invention, and is completely unexpected since, when file folders are placed with their labels facing downwardly, it is unexpected that the labels thereof can still be read. As a result, the present invention facilitates reaching for a desired file.

The angle of shelves 22–31 relative to the vertical can be reduced, so that the labels or file folders can be more easily read, but the result would be that the shelves would be more deeply inclined and the height of the resultant rack would have to be increased in order to store the same capacity of file folders or other materials therein. On the other hand, the angle of shelves 22–31 relative to the vertical can be increased, with the result that the shelf unit can be made shorter, but the result would be that it would be more difficult to read the downwardly facing file folder labels and, in addition, the depth the resultant structure would have to be increased in order to provide the same storage capacity.

It will be appreciated that, by angling shelves 22–31 as aforementioned, although there is a decrease in the height and depth of file folder/organizer rack 8, there is dead space A and above and below shelves 22–31, which does not normally occur with racks having a purely vertical or purely horizontal component to the shelves or compartments.

Therefore, according to another important feature of the present invention, an upper storage tray 60 is supported on upper horizontal twist-lock bars 14 and 16 at the upper portion of rack 8, above uppermost shelves 22 and 23, in order to utilize dead space A. Storage tray 60 includes a front shelf 61, a deep trough 65 and a ledge 66 for holding small items.

Specifically, front shelf 61 has a generally rectangular, planar configuration with parallel, spaced apart, lengthwise extending ridges 62, 63, 64 which define shallow channels 74 in order to, for example, retain pencils, pens, markers or the like therein. The front edge of storage tray 60 includes a downwardly extending flange 75 connected with the front edge of front shelf 61.

Deep trough 65 which can store larger items, such as film, tape, erasers or other products used in an office or home environment, is connected to and positioned rearwardly of front shelf portion 61. Deep trough 65 is formed generally as a U-shaped member with a flat support surface 76 and two upstanding vertical walls 77 and 78. The upper edge of vertical wall 77 is connected with the rear edge of front shelf 61. As with front shelf 61, flat support surface 76 is provided with a plurality, which as five, of parallel, spaced apart, lengthwise extending ridges 79 which define shallow channels 81.

Ledge 66 is connected to deep trough 65 for supporting other items which can be placed for storage or the like. Ledge 66 is connected at its forward edge with vertical wall 78 at a position spaced below the upper edge of vertical wall 78.

As discussed above, storage tray 60 is supported on upper horizontal twist-lock bars 14 and 16. Specifically, front shelf 61, front flange 75 and vertical wall 77 together form an inverted U-shaped configuration. Thus, front shelf 61 is supported on twist-lock bar 16, while front flange 75 and vertical wall 77 substantially inhibit forward and rearward movement of storage tray 60. Further, ledge 66 seats on twist-lock bar 14. With this arrangement, front shelf 61 and ledge 66 support storage tray 60 on twist-lock bars 16 and 14, respectively, and accordingly, deep trough 65 extends between twist-lock bars 14 and 16 and to a position lower than twist-lock bars 14 and 16, thereby utilizing dead space A. With this arrangement, not only is dead space A utilized, but also, a compact rack 8 is provided for holding both file folders and small item desk accessories.

Further, as shown in the drawings, support members 10 and 12 extend upwardly adjacent storage tray 60 so that end walls 10*a* and 12*a* provide side retaining members for materials placed on front shelf 61, deep trough 65 and ledge 66, while rear walls 10*b* and 12*b* provide rear retaining members for materials placed on ledge 66.

It will be appreciated that storage tray 60 is easily removable from rack 8 by merely lifting storage tray 60 up from twist-lock bars 14 and 16. In like manner, storage tray 60 can be replaced by merely placing storage tray 60 on upper bars 14 and 16 in the manner described above.

A lower storage tray 80 is positioned at the lower portion of rack 8, below lowermost shelves 30 and 31, in order to utilize dead space B. Storage tray 80 has an L-shaped configuration, with a lower supporting wall 82 and a rear supporting wall 84, for holding small items. The upper edge of rear supporting wall 84 includes a short, rearwardly extending ledge 86.

Angled support tabs 88 are connected at the inner surfaces of side walls 10*a* and 12*a* at positions immediately above lower, front twist-lock bar 20, and angled support tabs 90 are connected at the inner surfaces of side walls 10*a* and 12*a* at positions between and lower than twist-lock bars 18 and 20. Lower supporting wall 82 of storage tray 80 rests on angled support tabs 88 and 90, with rear supporting wall 84 abutting against lower, rear twist-lock bar 18 and the rear edge of ledge 86 abutting against the lower surfaces of shelves 30 and 31. Thus, dead space B is occupied by lower storage tray 80. Any items placed on lower storage tray 80 will fall rearwardly thereon to intersection of walls 82 and 84 thereof, and held on lower storage tray 80.

It will be appreciated that storage tray 80 is easily removable from rack 8 by merely lifting storage tray 80 up from tabs 88 and 90. In like manner, storage tray 80 can be replaced by merely placing storage tray 80 on tabs 88 and 90 in the manner described above.

It will be further appreciated that similar tabs could be provided for supporting upper storage tray 60, and in like manner, lower storage tray 80 could be supported on lower twist-lock bars 18 and 20. Alternatively, a combination support system of tabs and twist-lock bars could be utilized.

With the above arrangement, it will be appreciated that file folder/organizer rack 8 is easily molded from different parts and can be shipped in a disassembled state. Specifically, rack 8 is formed from the separately molded parts of left and right support members 10 and 12, bars 14–20, upper storage tray 60 and lower storage tray 80. In the storage or shipping state, support member 10 can be inverted relative to support member 12 so that shelves 22–30 and 21–31 can be interleaved for more compact shipping. Thus, rack 8 can ship in a disassembled, compact form, and can be easily assembled by a user.

Further, because shelves 22–30 and 21–31 do not extend along the entire width of rack 8, that is, due to the air space therebetween, and because of cut-out portions 22*a*–31*a* of shelves 22–31 and cut-out portions 11 and 13 of support members 10 and 12, rack 8 uses a reduced amount of plastic material in the molding operation in comparison to a one piece mold, thereby reducing the cost of the mold and the cost of the article.

However, even with such reduced plastic material, rack 8 still has good structural integrity.

Still further, because shelves 22–31 for holding the file folders are angled to provide a staggered relation, there is easy viewing of the labels on the file folders therein. This also provides a compact arrangement which is not too tall and not too deep.

At the same time, further storage trays 60 and 80 are provided for holding small items, thereby providing a combination file folder/small item file folder/organizer rack and utilizing the dead space created by the angled shelves.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

What is claimed is:

1. A file folder or organizer rack comprising:

a left support member including:

at least one supporting wall including a vertical support wall, and a plurality of parallel, spaced apart left shelves connected with said at least one supporting wall, each left shelf being angled downwardly and rearwardly, and each left shelf having a width no more than one-half of a width of said rack;

a right support member including:

at least one supporting wall including a vertical support wall, and a plurality of parallel, spaced apart right shelves connected with said at least one supporting wall of said right support member, each right shelf being angled downwardly and rearwardly, with each of said right shelves being in alignment with a respective left shelf, each right shelf having a width less than one-half of the width of said rack such that a horizontal space is provided between said left and right shelves; and a plurality of separate bars, said bars being separately formed with respect to said support members, and said bars having end portions removably interconnecting said at least one supporting wall of said left support member with said at least one supporting wall of said right support member, such that a space is also provided between said at least one supporting wall of said left and right support members, said bars having a fixed length, and each said bar having a first end engaged with the vertical support wall of said left support member and a second end engaged with the vertical support wall of the right support member, and said bars fixing a horizontal distance between said left and right support members to maintain said left and right support members spaced apart.

2. A file folder or organizer rack according to claim 1, wherein said at least one supporting wall of said left shelf has an L-shaped configuration with a side wall and a rear wall, and said at least one supporting wall of said right shelf has an L-shaped configuration with a side wall and a rear wall.

3. A file folder or organizer rack according to claim 1, wherein said shelves are connected to inner surfaces of both said side wall and said rear wall of the respective support member.

4. A file folder or organizer rack according to claim 1, wherein said left and right shelves are angled at approximately 45° to a vertical.

5. A file folder or organizer rack comprising:

a left support member including:

at least one supporting wall, and a plurality of parallel, spaced apart left shelves connected with said at least one supporting wall, each left shelf being angled downwardly and rearwardly, and each left shelf having a width less than one-half of the width of said rack;

a right support member including:

at least one supporting wall, and a plurality of parallel, spaced apart right shelves connected with said at least one supporting wall of said right support member, each right shelf being angled downwardly and rearwardly, with each of said right shelves being in alignment with a respective left shelf, each right shelf having a width less than one-half of the width of said rack such that a space is provided between said left and right shelves;

each of said left and right shelves is cut-out to define a substantially U-shaped configuration, with free ends of opposite legs thereof connected with said at least one supporting wall of the respective left and right support member; and a plurality of bars interconnecting said at least one supporting wall of said left support member with said at least one supporting wall of said right support member, such that said space is also provided between said at least one supporting wall of said left and right support members.

6. A file folder or organizer rack according to claim 5, wherein said at least one supporting wall of said left and right support members is cut-out in alignment with said cut-outs of said left and right shelves.

7. A file folder or organizer rack according to claim 1, wherein said bars removably interconnect said at least one supporting wall of said left support member with said at least one supporting wall of said right support member.

8. A file folder or organizer rack according to claim 1, wherein said at least one supporting wall of said left support member has four corner areas, said at least one supporting wall of said right support member has four corner areas, and there are four of said bars, each bar having a first end connected at respective ones of said corner areas of said at least one supporting wall of said left support member and a second end connected at respective ones of said corner areas of said at least one supporting wall of said right support member.

9. A file folder or organizer rack according to claim 1, wherein the width of each of said left and right shelves is equal to approximately 20% of the width of the rack.

10. A file folder or organizer rack according to claim 1, wherein each of said shelves is of an equal depth, with front edges of said shelves of each support member being in substantial vertical alignment and rear edges of said shelves of each support member being in substantial vertical alignment.

11. A file folder or organizer rack comprising:

a left support member including:

at least one supporting wall including a vertical support wall having a lower surface, and a plurality of parallel, spaced apart left shelves connected with said at least one supporting wall, each left shelf being angled downwardly and rearwardly, and each left shelf having a width less than one-half of a width of said rack;

a right support member including:

at least one supporting wall including a vertical support wall having a lower surface, and a plurality of parallel, spaced apart right shelves connected with said at least one supporting wall of said right support member, each right shelf being angled downwardly and rearwardly, with each of said right shelves being in alignment with a respective left shelf, each right shelf having a width less than one-half of the width of said rack such that a space is provided between said left and right shelves;

a plurality of bars interconnecting said at least one supporting wall of said left support member with said at least one supporting wall of said right support member, such that said space is also provided between said at least one supporting wall of each said left and right support members, each said bar having a first end engaged with the vertical support wall of said left support member and a second end engaged with the vertical support wall of the right support member, and said bars fixing a distance between said left and right support members;

an upper dead space defined above uppermost ones of said shelves and between said left and right support members; and an upper storage tray supported in said dead space and having a lower support surface substantially parallel with the lower surfaces of said vertical support walls.

12. A file folder or organizer rack according to claim 11, wherein said storage tray is supported on upper ones of said bars.

13. A file folder or organizer rack according to claim 11, wherein said storage tray includes:

a front shelf, a rear ledge, and a deep trough connected between and to said front shelf and said rear ledge.

14. A file folder or organizer rack according to claim 13, wherein at least one of said front shelf and rear ledge includes a plurality of parallel, spaced apart, lengthwise extending ridges on an upper support surface thereof.

15. A file folder or organizer rack comprising:

a left support member including:

at least one supporting wall, and a plurality of parallel, spaced apart left shelves connected with said at least one supporting wall, each left shelf being angled downwardly and rearwardly, and each left shelf having a width less than one-half of the width of said rack;

a right support member including:

at least one supporting wall, and a plurality of parallel spaced apart right shelves connected with said at least one supporting wall of said right support member, each right shelf being angled downwardly and rearwardly, with each of said right shelves being in alignment with a respective left shelf, each right shelf having a width less than one-half of the width of said rack such that a space is provided between said left and right shelves;

a plurality of bars interconnecting said at least one supporting wall of said left support member with said at least one supporting wall of said right support member, such that said space is also provided between said at least one supporting wall of said left and right support members;

an upper dead space defined above uppermost ones of said shelves and between said left and right support members; and an upper storage tray supported in said dead space, said storage tray including:

a front shelf, a rear ledge, a deep trough connected between and to said front shelf and said rear ledge, and said front shelf is supported on a front, upper one of said bars and said rear ledge is supported on a rear, upper one of said bars such that said deep trough extends to a position below said upper ones of said bars.

16. A file folder or organizer rack according to claim 15, wherein said front shelf includes a downwardly extending flange at a front edge thereof such that said deep trough and said downwardly extending flange inhibit forward and rearward movement of said storage tray.

17. A file folder or organizer rack according to claim 11, further comprising:

a lower dead space defined below lowermost ones of said shelves and between said left and right support members; and a lower storage tray supported in said lower dead space and extending continuously between said left and right support members.

18. A file folder or organizer rack according to claim 17, wherein said lower storage tray includes an L-shaped configuration, with a lower supporting wall and a rear supporting wall.

19. A file folder or organizer rack comprising:

a left support member including:

at least one supporting wall, and a plurality of parallel, spaced apart left shelves connected with said at least one supporting wall, each left shelf being angled downwardly and rearwardly, and each left shelf having a width less than one-half of a width of said rack;

a right support member including:

at least one supporting wall, and a plurality of parallel, spaced apart right shelves connected with said at least one supporting wall of said right support member, each right shelf being angled downwardly and rearwardly, with each of said right shelves being in alignment with a respective left shelf, each right shelf having a width less than one-half of the width of said rack such that a space is provided between said left and right shelves;

a plurality of bars interconnecting said at least one supporting wall of said left support member with said at least one supporting wall of said right support member, such that said space is also provided between said at least one supporting wall of said left and right support members;

an upper dead space defined above uppermost ones of said shelves and between said left and right support members;

an upper storage tray supported in said dead space;

a lower dead space defined below lowermost ones of said shelves and between said left and right support members; and a lower storage tray supported in said lower dead space, and said lower storage tray includes an L-shaped configuration, with a lower supporting wall and a rear supporting wall;

first angled support tabs connected at inner surfaces of said at least one supporting wall of said left and right support members, at positions above a front, lower one of said bars;

second angled support tabs connected at inner surfaces of said at least one supporting wall of said left and right support members, at positions between and lower than the front, lower one of said bars and a rear, lower one of said bars; and said lower supporting wall of the lower storage tray rests on said angled support tabs and said rear supporting wall of the lower storage tray abutting against the rear, lower one of said bars.

20. A file folder or organizer rack according to claim 11, wherein said at least one supporting wall of each of said left and right shelves has an L-shaped configuration with a side wall and a rear wall.

21. A file folder or organizer rack according to claim 11, wherein said shelves are connected to inner surfaces of both said side wall and said rear wall of the respective support member.

22. A file folder or organizer rack according to claim 11, wherein said left and right shelves are angled at approximately 45° to a vertical.

23. A file folder or organizer rack comprising:

a left support member including:

at least one supporting wall, and a plurality of parallel, spaced apart left shelves connected with said at least one supporting wall, each left shelf being angled downwardly and rearwardly, and each left shelf having a width less than one-half of a width of said rack;

a right support member including:

at least one supporting wall, and a plurality of parallel, spaced apart right shelves connected with said at least one supporting wall of said right support member, each right shelf being angled downwardly and rearwardly, with each of said right shelves being in alignment with a respective left shelf, each right shelf having a width less than one-half of the width of said rack such that a space is provided between said left and right shelves;

each of said left and right shelves is cut-out to define a substantially U-shaped configuration, with free ends of opposite legs thereof connected with said at least one supporting wall of the respective left and right support member;

a plurality of bars interconnecting said at least one supporting wall of said left support member with said at least one supporting wall of said right support member, such that said space is also provided between said at least one supporting wall of said left and right support members;

an upper dead space defined above uppermost ones of said shelves and between said left and right support members;

an upper storage tray supported in said dead space.

24. A file folder or organizer rack according to claim 23, wherein said at least one supporting wall of said left and right support members is cut-out in alignment with said cut-outs of said left and right shelves.

25. A file folder or organizer rack according to claim 11, wherein said bars removably interconnect said at least one supporting wall of said left support member with said at least one supporting wall of said right support member.

26. A file folder or organizer rack according to claim 11, wherein said at least one supporting wall of said left support member has four corner areas, said at least one supporting wall of said right support member has four corner areas, and there are four said supporting bars, each supporting bar having a first end connected at respective ones of said corner areas of said at least one supporting wall of said left support member and a second end connected at respective ones of said corner areas of said at least one supporting wall of said right support member.

27. A file folder or organizer rack according to claim 11, wherein the width of each of said left and right shelves is equal to approximately 20% of the width of the rack.

28. A file folder or organizer rack according to claim 11, wherein each of said shelves is of an equal depth, with front edges of said shelves of each support member being in vertical alignment and rear edges of said shelves of each support member being in vertical alignment.

29. A file folder or organizer rack comprising:

a left support member including:

at least one supporting wall including a vertical support wall, and a plurality of parallel, spaced apart left shelves connected with said at least one supporting wall, each left shelf being angled downwardly and rearwardly, and each left shelf having a width less than one-half of a width of said rack;

a right support member including:

at least one supporting wall including a vertical support wall, and a plurality of parallel, spaced apart right shelves connected with said at least one supporting wall of said right support member, each right shelf being angled downwardly and rearwardly, with each of said right shelves being in alignment with a respective left shelf, each right shelf having a width less than one-half of the width of said rack such that a space is provided between said left and right shelves;

a plurality of fixed length bars interconnecting said at least one supporting wall of said left support member with said at least one supporting wall of said right support member, such that said space is also provided between said at least one supporting wall of said left and right support members, each said bar having a first end engaged with the vertical support wall of said left support member and a second end engaged with the vertical support wall of the right support member, and said bars fixing a distance between said left and right support members;

a lower dead space defined below lowermost ones of said shelves and between said left and right support members; and a lower storage tray supported in said dead space and extending continuously between said left and right support members.

30. A file folder or organizer rack according to claim 29, wherein said lower storage tray includes an L-shaped configuration, with a lower supporting wall and a rear supporting wall.

31. A file folder or organizer rack comprising:

a left support member including:

at least one supporting wall, and a plurality of parallel, spaced apart left shelves connected with said at least one supporting wall, each left shelf being angled downwardly and rearwardly and each left shelf having a width less than one-half of a width of said rack;

a right support member including:

at least one supporting wall, and a plurality of parallel, spaced apart right shelves connected with said at least one supporting wall of said right support member, each right shelf being angled downwardly and rearwardly, with each of said right shelves being in alignment with a respective left shelf, each right shelf having a width less than one-half of the width of said rack such that a space is provided between said left and right shelves;

a plurality of bars interconnecting said at least one supporting wall of said left support member with said at least one supporting wall of said right support member, such that said space is also provided between said at least one supporting wall of said left and right support members;

a lower dead space defined below lowermost ones of said shelves and between said left and right support members; and a lower storage tray supported in said dead space, said lower storage tray including an L-shaped configuration, with a lower supporting wall and a rear supporting wall;

first angled support tabs connected at inner surfaces of said at least one supporting wall of said left and right support members, at positions above a front, lower one of said bars;

second angled support tabs connected at inner surfaces of said at least one supporting wall of said left and right support members, at positions between and lower than the front, lower one of said bars and a rear, lower one of said bars; and said lower supporting wall of the lower storage tray resting on said angled support tabs and said rear supporting wall of the lower storage tray abutting against the rear, lower one of said bars.

32. A file folder or organizer rack according to claim 29, wherein said at least one supporting wall of each of said left and right shelves has an L-shaped configuration with a side wall and a rear wall.

33. A file folder or organizer rack according to claim 29, wherein said left and right shelves are angled at approximately 45° to a vertical.

34. A file folder or organizer rack comprising:

a left support member including:

at least one supporting wall, and a plurality of parallel, spaced apart left shelves connected with said at least one supporting wall, each left shelf being angled downwardly and rearwardly, and each left shelf having a width less than one-half of a width of said rack;

a right support member including:

at least one supporting wall, and a plurality of parallel, spaced apart right shelves connected with said at least one supporting wall of said right support member, each right shelf being angled downwardly and rearwardly, with each of said right shelves being in alignment with a respective left shelf, each right shelf having a width less than one-half of the width of said rack such that a space is provided between said left and right shelves;

each of said left and right shelves is cut-out to define a substantially U-shaped configuration, with free ends of opposite legs thereof connected with said at least one supporting wall of the respective left and right support member;

a plurality of bars interconnecting said at least one supporting wall of said left support member with said at least one supporting wall of said right support member, such that said space is also provided between said at least one supporting wall of said left and right support members;

a lower dead space defined below lowermost ones of said shelves and between said left and right support members; and a lower storage tray supported in said dead space.

35. A file folder or organizer rack according to claim 34, wherein said at least one supporting wall of said left and right support members is cut-out in alignment with said cut-outs of said left and right shelves.

* * * * *